United States Patent [19]

Hasker et al.

[11] 4,221,988

[45] Sep. 9, 1980

[54] LOW PRESSURE GAS DISCHARGE LAMP HAVING FIBERS EVENLY DISTRIBUTED BETWEEN THE ELECTRODES

[75] Inventors: Jan Hasker; Petrus R. van Ijzendoorn; Hendrik Roelofs, all of Eindhoven, Netherlands

[73] Assignee: U.S. Philips Corporation, New York, N.Y.

[21] Appl. No.: 956,309

[22] Filed: Oct. 31, 1978

Related U.S. Application Data

[62] Division of Ser. No. 877,162, Feb. 13, 1918, Pat. No. 4,143,447.

[30] Foreign Application Priority Data

Jan. 23, 1977 [NL] Netherlands ..... 7701910

[51] Int. Cl.[2] ..... H01J 61/04

[52] U.S. Cl. ..... 313/203

[58] Field of Search ..... 313/203, 485, 116, 110 (U.S. only)

[56] References Cited

U.S. PATENT DOCUMENTS

| | | | |
|---|---|---|---|
| 2,133,205 | 10/1938 | McCauley | 313/203 X |
| 2,170,066 | 8/1939 | Ruben | 313/203 X |
| 2,824,993 | 2/1958 | Vriend et al. | 313/485 |

FOREIGN PATENT DOCUMENTS

| | | | |
|---|---|---|---|
| 7409366 | 1/1976 | Netherlands | 313/203 |

*Primary Examiner*—Robert Segal
*Attorney, Agent, or Firm*—Robert S. Smith

[57] ABSTRACT

A low pressure gas discharge lamp having a body present in the discharge vessel which consists of a longitudinal support which extends into the longitudinal direction of the vessel, the support being provided with fibers which are distributed over the space within the discharge vessel and extend substantially transversely from the support.

8 Claims, 2 Drawing Figures

Figure 1:
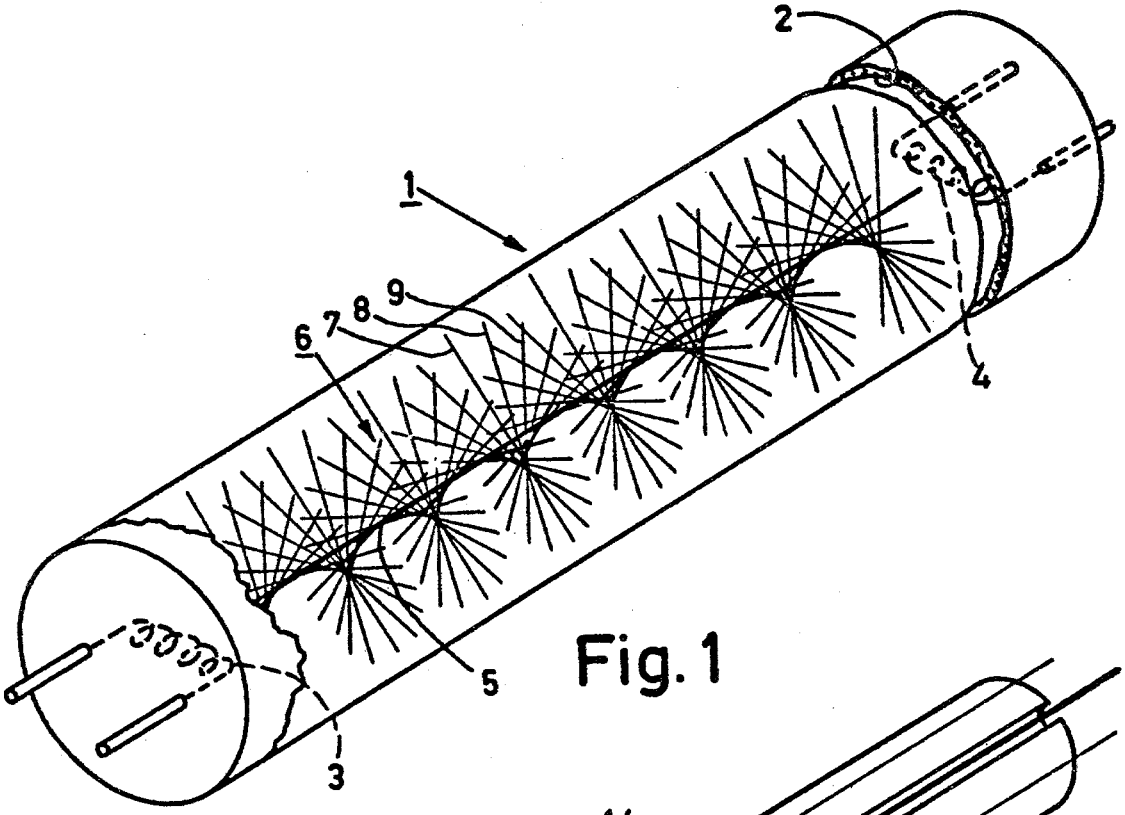

LOW PRESSURE GAS DISCHARGE LAMP HAVING FIBERS EVENLY DISTRIBUTED BETWEEN THE ELECTRODES

This is a division of application Ser. No. 877,162, filed Feb. 13, 1978.

The invention relates to a low-pressure discharge lamp with a discharge vessel in which a body having a thinly-distributed structure which is permeable to the discharge is disposed between the electrodes. Furthermore, the invention relates to a method for producing such lamps.

From Dutch Patent Application No. 7409366 which has been laid open to public inspection it is known to provide the discharge vessel of low pressure gas discharge lamps, such as low pressure mercury vapor discharge lamps and low pressure sodium vapor discharge lamps with a body of solid matter having a structure which is transmissive to the discharge, such as thinly distributed glass wool, quartz glass or gehlenite glass wool in order to increase the luminous flux per unit of lamp volume.

The effect of the presence of said body in the discharge space is that at the same current strength through the lamp the lamp voltage can considerably be increased; the detrimental effects which occur with lamps without such a body if the lamp power is increased by stepping up the lamp current, occurring to a considerably lesser degree.

One of the requirements with lamps, low pressure mercury discharge lamps in particular, provided with such a body having a thin structure, must satisfy is that the distribution of the elements from which the body is composed is sufficiently uniform because otherwise, owing to non-homogeneities in the discharge unwanted light intensity and temperature differences over the tube wall are produced. In low pressure mercury discharge lamps the temperature differences result in mercury deposit on the colder parts and in low pressure sodium lamps in the formation of sodium mirrors on the colder spots.

It is an object of the invention to provide a lamp which satisfies the above-mentioned requirement. At the same time it is an object of the invention to provide a thin body which can be produced outside the discharge vessel and which is sufficiently rigid so that it can be disposed in a simple manner in the discharge vessel without unwanted changes in the form being produced.

A low pressure discharge lamp of the type mentioned in the preamble is characterized in accordance with the invention in that the body consists of a longitudinal support, extending in the longitudinal direction of the discharge vessel, provided with fibers which are distributed over the space within the discharge vessel and extending into the transverse direction of the support.

The thin body used in accordance with the invention is sufficiently rigid so that hardly any form changes are produced during fabrication of the lamp. Consequently the required uniform structure is retained. In addition the body can be fixed in a simple manner in the discharge vessel by fitting, for example, one end of the support to the wall of the discharge vessel by means of an adhesive, such as glass enamel. Also during the so-called "exhausting" of the lamp, after the body has been disposed in the discharge vessel, the arrangement of the fibers, owing to the rigidity of the body, is hardly disturbed.

In an embodiment of a lamp according to the invention, especially with lamps having a cylindrical discharge vessel, the support is disposed at or near the longitudinal axis of the discharge vessel. In such a lamp a stable and uniform build-up of the discharge is obtained and the intensity and temperature distribution over the wall is very uniform.

In a further embodiment of a lamp according to the invention the fibers extend to as far as the wall of the discharge vessel. As a consequence, without further auxiliary means the entire structure is properly positioned in the discharge vessel which also results in a stable and uniform build-up of the discharge.

The fibers are preferably secured to the support by means of an adhesive. An example of an adhesive which is disposed in the form of a coating on the support is Capton (Trade Mark). After the adhesion between fibers and support has been effected the coating is, if necessary, baked to remove the binder necessary for applying the coating and for hardening the coating itself. The coating may also serve as electrical insulator.

The support preferably consists of a metal wire which is provided with an electrically insulating coating to prevent short-circuiting of the discharge. Glass enamel may, for example, be chosen as the insulating coating. This has the advantage that the coating may also serve as the connection between the fibers and the supporting wire. This connection can, for example, be made by heating the supporting wire, for example by means of an electric current. This causes the glass enamel to soften and, hence, to hold the fibers. On cooling of the wire a rigid connection is made between the fibers and the support wire.

The radiant flux of a lamp according to the invention is particularly high if the thinly distributed body has a low absorption for the useful radiation produced by the discharge, which may be located both in the visible and in the ultra-violet part of the spectrum. The fibers are chosen such that the useful radiation is properly transmitted. The fibers preferably consists of quartz or glass. If the fibers have too strong an absorption for the useful radiation a surface coating at which reflection is produced can be applied. This surface coating is, for example, magnesium oxide or titanium oxide.

The body having a structure and a form according to the invention is produced before it is brought into the discharge vessel. The body may be formed by connecting a wire-shaped support to a plurality of fibres which are situated substantially perpendicularly to the support whereafter the support is twisted about its axis so that the fibers extend into spacially distributed directions.

Preferably in a method according to the invention a metal wire which is coated with a layer of glass enamel is disposed in a longitudinal groove of a cylindrical jig whereafter glass or quartz fibre wire is wound on the jig whereby the supporting wire is heated and the glass enamel softens so that fusion of the supporting wire with the fiber wire is effected, whereafter the fiber wire is cut over the surface of the jig at at least one side of the supporting wire so that a plurality of fibers is formed. The supporting wire provided with fibers is thereafter twisted about its axis outside the groove while being heated. Thereafter the entire structure thus obtained is pushed into the discharge vessel and the further lamp operations are performed.

The pitch of the glass fiber wire wound around the winding jig determines the ultimate density of the structure built-up on the metal supporting wire.

The production of the above-mentioned bodies can be accelerated by using a winding jig having a large diameter in which several longitudinal grooves with supporting wires are disposed and/or by winding several fibre wires simultaneously.

The invention can be used for many diverse kinds of low pressure gas discharge lamps; typical examples being low pressure sodium discharge lamps and low pressure mercury discharge lamps, either provided or not provided with a luminescent coating. The discharge vessel need not of necessity be cylindrical. The discharge vessel may be U-shaped, a respective body being provided in either leg of the "U". It is also not necessary for the support to be arranged at or near the longitudinal axis of the discharge vessel. With certain types of compact fluorescent lamps it may be advantageous to dispose the support excentrically in the discharge vessel.

An embodiment of the invention will now be further explained with reference to a drawing.

In a drawing

Figure 2:
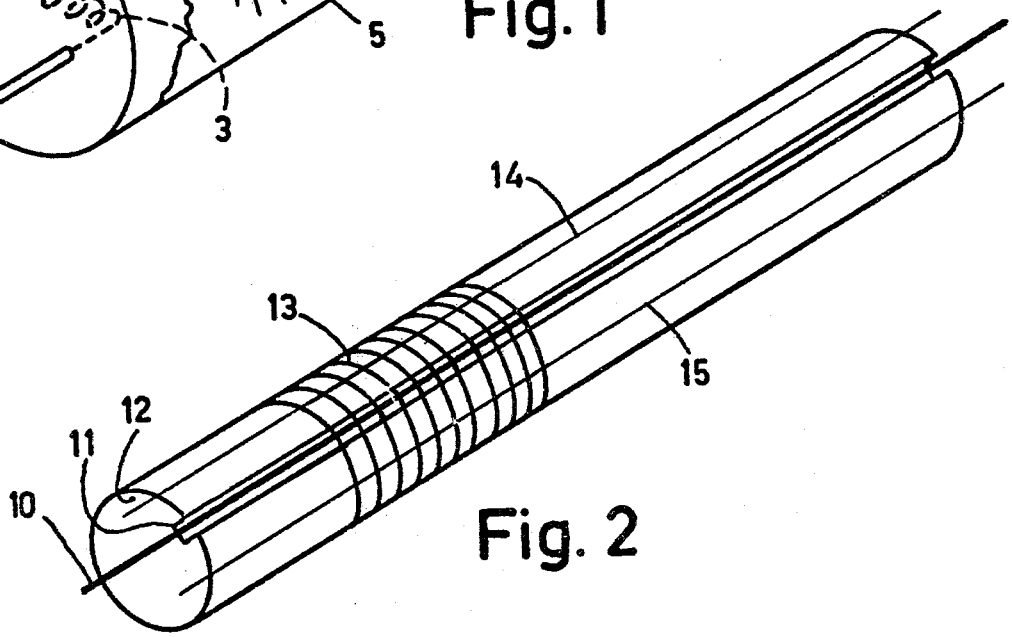

FIG. 1 shows a low pressure mercury vapor discharge lamp according to the invention having a thin body of solid matter in the cylindrical discharge vessel, and FIG. 2 shows a support wire with associated winding jig for performing a method of producing the thin body.

The lamp shown in FIG. 1 has a tubular glass discharge vessel 1 which is provided at the inside with a luminescent coating 2, consisting for example of calcium halophosphate activated by manganese and antimony. In the discharge vessel there is mercury vapour with a pressure of approximately $6\times10^{-3}$ Torr and a rare gas or rare gas mixture with a pressure of some Torr. Disposed in the discharge vessel between the electrodes 3 and 4, respectively, there is a longitudinal body consisting of a support 5 of wire of a chromium-nickel-iron alloy; the wire is coated with a layer of glass enamel by means of which the glass fiber 6, which are approximately 20 μm thick have been fused to the wire. The support extends along the longitudinal axis of the discharge vessel. Each fiber, whose length is substantially equal to the diameter of the discharge vessel is centrally fastened to the support. The space between two successive fibers is approximately 80 μm. Two successive fibers (for example 7 and 8 or 8 and 9) are at a substantial constant angle of approximately 7° to one another. The structure shown in FIG. 1 is produced by means of a method which is described in greater detail in FIG. 2.

A lamp in which the above-described body is disposed is, at a tube diameter of 2.5 cm, an electrode spacing of 20 cm and a length of the body of almost 20 cm., if a rare gas filling (neon) with a pressure of 4 torr is used, suitable for operation in series with a self-induction stabilization element (ballast) of small dimensions from a 220 V mains voltage. With a lamp power of 20 W the luminous flux then amounts to 1000 lumens and the efficiency of lamp and stabilization element is approximately 40 lm/W. For a similar operation from a 120 V mains voltage the operating voltage of the lamp must be decreased. This can be realized by using a rare gas filling of a mixture of 50 percent by volume of argon and 50% by volume of neon at a pressure of 2.5 torr. With the same dimensions of lamp, body and stabilization element, at a lamp power of 20 W the total luminous flux is then 1200 lm and the efficiency of lamp and stabilization element approximately 45 lm/W.

In FIG. 2 a rolled metal wire of an alloy with a suitable coefficient of expansion, 0.1 mm thick and 0.3 mm wide, is indicated by 10. The wire is coated with a layer of glass enamel, approximately 20 μm thick. The wire is disposed in a longitudinal groove 11 in a cylindrical winding jig 12, the winding jig is wound evenly with glass fiber wire 13 having a thickness of approximately 20 μm. The winding pitch is 100 μm. During winding a current of 1 Amp. is passed through the metal wire which causes the glass enamel to soften and to effect fusion with the glass fibre wire 13. Thereafter the wound glass fiber wire is cut along two lines 14 and 15 approximately equidistant from the metal wire over the surface of the jig parallel with the metal wire 10. Thereafter the wire 10 is removed from the longitudinal groove 11 and twisted. The twisting pitch is approximately 5 mm. Because the glass enamel must be soft during twisting a current of approximately 0.9 A is passed through the wire during this operation. After twisting and hardening of the glass enamel the brush-like body then obtained is pushed into the discharge vessel.

What is claimed is

1. An elongated low pressure gas discharge lamp having electrodes at opposite end, said lamp comprising a discharge vessel and a body having a thinly distributed structure which is permeable to the discharge disposed in said vessel, said body consisting of a longitudinal support extending in the longitudinal direction of the discharge vessel, and fibers connected thereto which are evenly distributed over the space within the discharge vessel and which extend to the wall of the discharge vessel in a direction which is substantially transverse to said support.

2. A low pressure gas discharge lamp as claimed in claim 1, wherein said support is disposed at or near the axis of said discharge vessel.

3. An elongated low pressure gas discharge lamp having electrodes at opposite ends, said lamp comprising a discharge vessel and a body having a thinly distributed structure which is permeable to the discharge disposed in said vessel, said body consisting of a longitudinal support extending in the longitudinal direction of the discharge vessel, and fibers connected thereto which are evenly distributed over the space within the discharge vessel and which extend the wall of the discharge vessel in a direction which is substantially transverse to said support, said fibers being connected to said support by means of an adhesive.

4. A low pressure gas discharge lamp as claimed in claim 3, wherein aid adhesive is in the form of a coating on said support.

5. A low pressure gas discharge lamp as claimed in claim 1, wherein said support is a metal wire which is coated with an electrically insulating coating.

6. A low pressure gas discharge lamp as claimed in claim 5, wherein said insulating coating is glass enamel.

7. A low pressure gas discharge lamp as claimed in claim 1, wherein said fibers are quartz or glass fibers.

8. A low pressure gas discharge lamp as claimed in claims 1, 4, 5, 6 or 7, wherein each of said fibers are fastened at substantially the same axial distance from each adjacent fiber on said support, successive fibers being at an angular orientation which is substantially the same.

* * * * *

UNITED STATES PATENT AND TRADEMARK OFFICE

CERTIFICATE OF CORRECTION

PATENT NO. : 4,221,988

DATED : September 9, 1980

INVENTOR(S) : JAN HASKER et al

It is certified that error appears in the above—identified patent and that said Letters Patent is hereby corrected as shown below:

On the Title Page under Related U.S. Application Data, item [62] should read -- Division of Ser. No. 877,162, Feb. 13, 1978, Pat. No. 4,143,447 --.

On the Title Page under Foreign Application Priority Data, item [30] should read -- Feb. 23, 1977 [NL] Netherlands .... 7701910 -- .

Col. 4, Line 27, Claim 1, After " opposite " change " end " to -- ends -- .

Col. 4, Line 53, Claim 4, After " wherein " change " aid " to -- said -- .

Signed and Sealed this

Third Day of November 1981

[SEAL]

Attest:

GERALD J. MOSSINGHOFF

Attesting Officer

Commissioner of Patents and Trademarks